US010403974B2

(12) United States Patent
Moon et al.

(10) Patent No.: US 10,403,974 B2
(45) Date of Patent: Sep. 3, 2019

(54) COMPACT ANTENNA APPARATUS FOR MOBILE COMMUNICATION SYSTEM

(71) Applicant: KMW INC., Hwaseong-si (KR)

(72) Inventors: Young-Chan Moon, Suwon-si (KR); In-Ho Kim, Yongin-si (KR); Oh-Seog Choi, Suwon-si (KR); Hyoung-Seok Yang, Hwaseong-si (KR); Sang-Hyeong Kim, Seongnam-si (KR); Hee Kim, Yongin-si (KR); Hye-Mi Jung, Osan-si (KR)

(73) Assignee: KMW INC., Hwaseong-si (KR)

( * ) Notice: Subject to any disclaimer, the term of this patent is extended or adjusted under 35 U.S.C. 154(b) by 37 days.

(21) Appl. No.: 15/611,792

(22) Filed: Jun. 2, 2017

(65) Prior Publication Data

US 2017/0271760 A1 Sep. 21, 2017

Related U.S. Application Data

(63) Continuation of application No. PCT/KR2015/013036, filed on Dec. 2, 2015.

(30) Foreign Application Priority Data

Dec. 2, 2014 (KR) ..... 20-2014-0008847

(51) Int. Cl.
*H01Q 3/32* (2006.01)
*H01Q 3/08* (2006.01)
(Continued)

(52) U.S. Cl.
CPC ..... *H01Q 3/08* (2013.01); *H01P 1/18* (2013.01); *H01P 1/184* (2013.01); *H01Q 1/246* (2013.01);
(Continued)

(58) Field of Classification Search
CPC ..... H01Q 1/1228; H01Q 3/00–3/08; H01Q 1/42; H01Q 3/22; H01Q 3/26;
(Continued)

(56) References Cited

U.S. PATENT DOCUMENTS 7,286,092 B2 * 10/2007 Trejtnar ..... H01Q 1/246 343/702
2010/0201590 A1 * 8/2010 Girard ..... H01Q 1/246 343/766
2010/0201591 A1 * 8/2010 Girard ..... H01Q 1/246 343/766

FOREIGN PATENT DOCUMENTS

JP 2007-508723 A 4/2007
JP 2013-021406 A 1/2013
(Continued)

OTHER PUBLICATIONS

International Search Report for PCT/KR2015/013036, dated Mar. 28, 2016, and its English translation.

*Primary Examiner* — Dameon E Levi
*Assistant Examiner* — Hasan Z Islam

(57) ABSTRACT

A compact antenna apparatus for a mobile communication system includes: a radome having at least one frequency band radiating element provided therein; at least one phase shifter portion which is provided in an inner side of the radome and which is connected to the radiating element to adjust a tilting angle of the radiating element; and a rotary knob portion which is provided so as to be exposed to the outside of the radome and which is directly coupled to the phase shifter portion to drive a phase shifter.

12 Claims, 7 Drawing Sheets

(51) Int. Cl.

| | |
|---|---|
| ***H01Q 1/42*** | (2006.01) |
| ***H01Q 3/26*** | (2006.01) |
| ***H01P 1/18*** | (2006.01) |
| ***H01Q 3/02*** | (2006.01) |
| ***H01Q 3/22*** | (2006.01) |
| ***H01Q 21/10*** | (2006.01) |
| ***H01Q 1/24*** | (2006.01) |
| *H01Q 1/12* | (2006.01) |

(52) U.S. Cl.
CPC ..... *H01Q 1/42* (2013.01); *H01Q 3/02* (2013.01); *H01Q 3/22* (2013.01); *H01Q 3/26* (2013.01); *H01Q 3/32* (2013.01); *H01Q 21/10* (2013.01); *H01Q 1/1228* (2013.01)

(58) Field of Classification Search
CPC .. H01Q 3/30–3/32; H01Q 21/08–21/10; H01P 1/18; H01P 1/184
See application file for complete search history.

(56) References Cited

FOREIGN PATENT DOCUMENTS

| | | | |
|---|---|---|---|
| KR | 10-2003-0012131 | A | 2/2003 |
| KR | 10-2007-0049459 | A | 5/2007 |
| KR | 10-2010-0117838 | A | 11/2010 |
| KR | 10-2010-0122092 | A | 11/2010 |
| KR | 10-2014-0033921 | A | 3/2014 |

* cited by examiner

COMPACT ANTENNA APPARATUS FOR MOBILE COMMUNICATION SYSTEM

CROSS-REFERENCE TO RELATED APPLICATIONS

This application is a continuation of International Application No. PCT/KR2015/013036 filed on Dec. 2, 2015, which claims priority to Korean Application No. 20-2014-0008847 filed on Dec. 2, 2014, the entire contents of which are incorporated herein by reference.

TECHNICAL FIELD

The present disclosure relates to a compact antenna apparatus that may be applied to a base station or a relay station in a mobile communications (PCS, cellular, CDMA, GSM, LTE, etc.) network.

BACKGROUND ART

Typically, a base station of a mobile communication system has been divided into a base station main body apparatus for processing a transmitting and receiving signal and an antenna apparatus including a plurality of radiating elements to transmit and receive radio signals. Generally, the base station main body apparatus is installed at a low-lying land on the ground and the antenna apparatus is installed at high positions such as a building roof and a tower. The base station main body apparatus and the antenna apparatus may be connected to each other through a feed cable or the like.

In addition, in the current mobile communication environment, 2 generation (2G), 3G, and 4G long term evolution (LTE) have not only been commercialized, but the introduction of the next generation 5G system has also been considered. Accordingly, various frequency bands of mobile communication services are mixed according to the communication systems or service providers and countries, and the base station environment is also diversified. Accordingly, since the communication environment has service bands frequently changed for each specific service provider, in order to realize an efficient base station system and to reduce the operating cost of the base station, the base station (and base station antenna apparatus) constructs a broadband system capable of covering various service bands.

Meanwhile, in the mobile communication services using a radio wave, there may be areas to which the radio wave cannot be transmitted according to the environment, such as terrains and buildings, due to characteristics of the radio wave. Therefore, recently, a compact antenna apparatus is installed on an outer wall of a building, or the like at a low-lying land on the ground in order to remove a shaded area where the radio wave cannot be transmitted according to the environment. In addition, in the compact antenna apparatuses installed on an outer wall or the like at a low-lying land on the ground are installed with radiating elements having at least one of high frequency bands.

As the compact antenna apparatus for the mobile communication base station is installed at a low-lying land, in appearance, the compact antenna apparatus should not have a size at which a user may feel uncomfortable, etc. That is, in the compact antenna apparatus, a size of a radome provided with the radiating element cannot but be relatively small, and therefore the compact antenna apparatus has a problem in that a space for an automatic tilting module for automatically adjusting a tilting angle of the radiating element like a large antenna apparatus may not be secured.

In addition, the compact antenna apparatuses are greatly affected by buildings and terrains due to the high frequency band and therefore should be installed in a lot of places. However, there may be the problem that the installation of the automatic tilting module in each compact antenna apparatus requires high additional expenses.

In addition, since the size of the radome is small in the compact antenna apparatus, the number of radiating elements installed in the compact antenna apparatus should be inevitably much smaller than that of the large antenna apparatus. For example, compared to the number of radiating elements installed in a large antenna apparatus installed on an outer wall of a high-rise building, the number of radiating elements installed in the large antenna apparatus are about ⅓ or less. If the angle is adjusted by automatically tilting a small number of radiating elements installed in the radome, the tilting angle of the radiating element installed in the compact antenna apparatus is smaller than that of the radiating element of the large antenna apparatus. That is, if the tilting angle of the radiating element is automatically adjusted, the radiating element of the compact antenna apparatus has a problem in that an error range of the tilting angle becomes large. In addition, the compact antenna apparatus is implemented as a high frequency band. If the error of the tilting angle becomes large, there may arise a problem in that the frequency band may be changed, radiation performance may be degraded, the radiation performance may not be realized properly, or the like. Further, if the antenna apparatus is installed on the high outer wall, it is difficult for an operator to manually adjust the tilting angle of the radiating element. However, in the case of the compact antenna installed on a low outer wall or a low-lying land, there is a need for an operator to more easily adjust the tilting angle of the radiating element than the automated tilting operation.

DISCLOSURE

Technical Problem

An object of the present disclosure is to provide an optimized compact antenna apparatus for a mobile communication system capable of reducing an error of a tilting element of a radiating element to maintain high radiation performance, sufficiently overcoming restrictions on an installation space of the antenna apparatus, and reducing material cost, processing cost, and installation cost, by improving a tilting angle adjusting structure of the radiating element in the compact antenna apparatus in a low-lying area.

Technical Solution

In one general aspect, a compact antenna apparatus for a mobile communication system includes: a radome having at least one frequency band radiating element provided therein; at least one phase shifter portion which is provided in an inner side of the radome and which is connected to the radiating element to adjust a tilting angle of the radiating element; and a rotary knob portion which is provided so as to be exposed to the outside of the radome and which is directly coupled to the phase shifter portion to drive a phase shifter.

Advantageous Effects

The antenna apparatus for a mobile communication system according to the embodiment of the present disclosure can accurately adjust the tilting angle of the radiating element of the compact antenna apparatus installed in the user environment and minimize the error range of the tilting angle to improve the accuracy of the beam forming of the radiating element.

In addition, the installation of the existing unnecessary structures that are inaccurately tilted and have the large error in the tilting angle may be limited to secure the installation space and reduce the material cost, the processing cost, and the installation cost to thereby minimize the unnecessary cost, such that the products with price competitiveness can be manufactured.

DETAILED DESCRIPTION OF MAIN ELEMENTS

100: Compact antenna apparatus for mobile communication system

110: Radome

120: Rotary knob portion 130: Phase shifter portion

BEST MODE

The present disclosure may be modified in various ways and implemented by various exemplary embodiments, so that some exemplary embodiments are described in detail with reference to the accompanying drawings. However, it is to be understood that the present disclosure is not limited to the specific exemplary embodiments, but includes all modifications, equivalents, and substitutions included in the spirit and the scope of the present disclosure.

Terms including an ordinal number such as 'first', 'second', etc. can be used to describe various components, but the components are not to be construed as being limited to the terms. The terms are only used to differentiate one component from other components. For example, the 'first' component may be named the 'second' component and the 'second' component may also be similarly named the 'first' component, without departing from the scope of the present disclosure. The term 'and/or' includes a combination of a plurality of items or any one of a plurality of terms.

Further, relative terms such as 'front surface', 'rear surface', 'upper surface', 'lower surface', or the like described based on those shown in drawings may be replaced by ordinal numbers such as 'first', 'second', or the like. In the ordinal numbers such as 'first', 'second', the order thereof is defined as described or arbitrarily defined and may be randomly changed as needed.

Terms used in the present specification are used only for describing specific embodiments of the present disclosure rather than limiting the present disclosure. Singular forms used herein are intended to include plural forms unless context explicitly indicates otherwise. Throughout this specification, it will be understood that the term "comprise" and variations thereof, such as "comprising" and "comprises", specify the presence of features, numbers, steps, operations, components, parts, or combinations thereof, described in the specification, but do not preclude the presence or addition of one or more other features, numbers, steps, operations, components, parts, or combinations thereof.

Unless indicated otherwise, it is to be understood that all the terms used in the specification including technical and scientific terms has the same meaning as those that are generally understood by those who skilled in the art. It must be understood that the terms defined by the dictionary are identical with the meanings within the context of the related art, and they should not be ideally or excessively formally defined unless the context clearly dictates otherwise.

Figure 1:
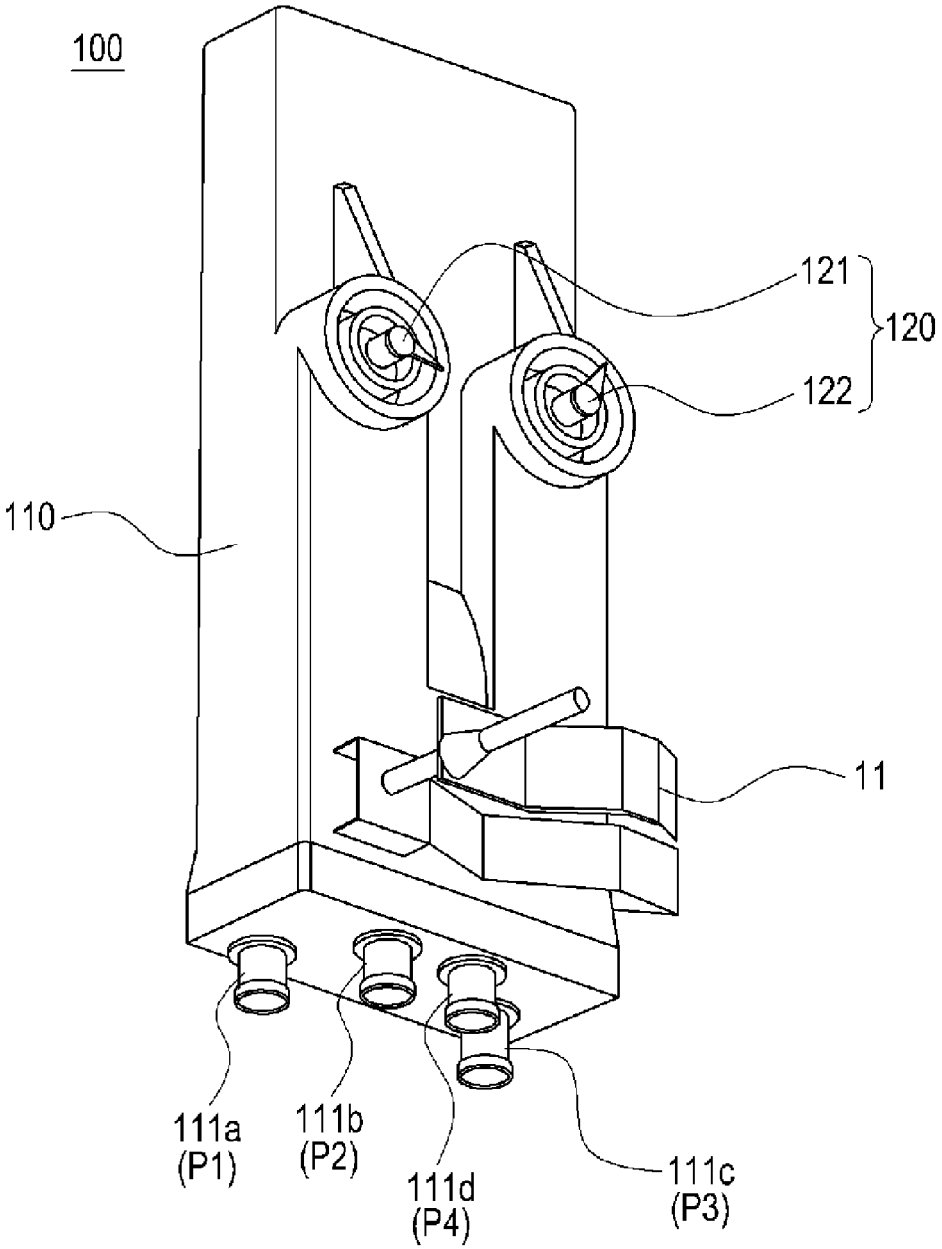
FIG. 1 is a perspective view of a compact antenna apparatus for a mobile communication system according to an embodiment of the present disclosure.
Figure 2:
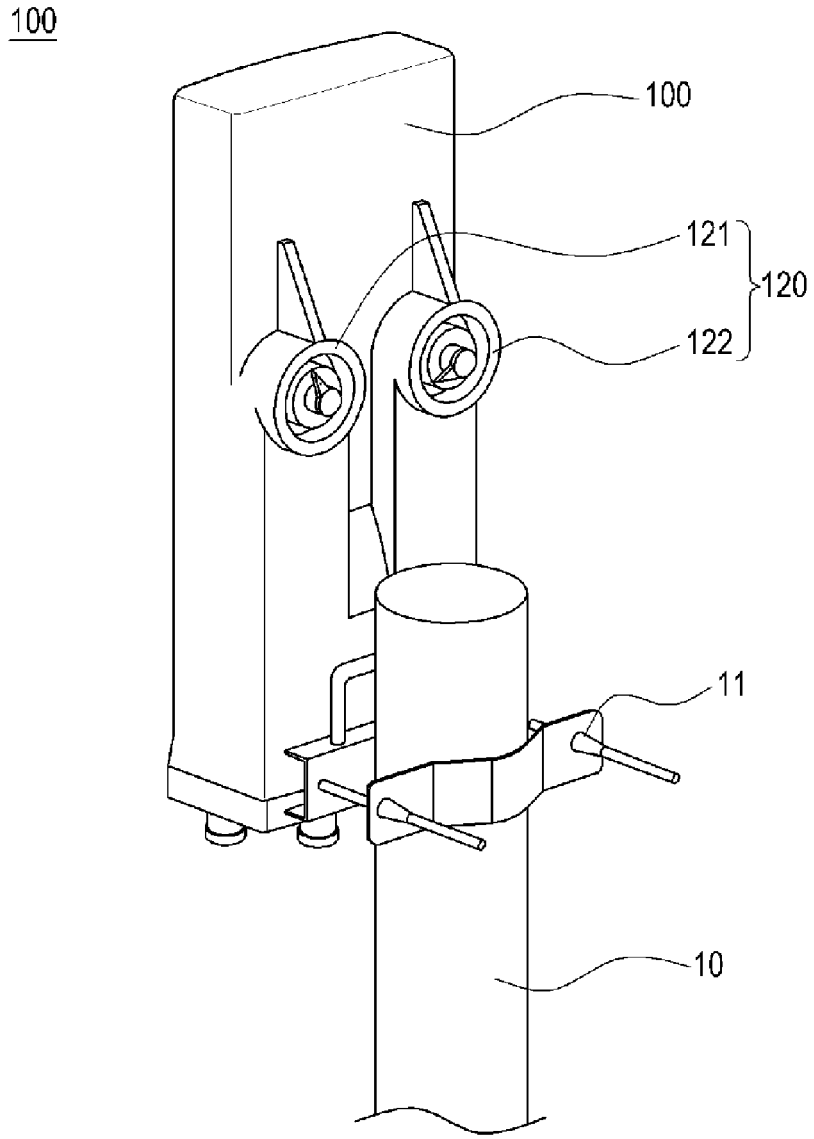
FIG. 2 is a view showing a state in which the compact antenna apparatus is installed on a low-floor outer wall, in the compact antenna apparatus for a mobile communication system according to the embodiment of the present disclosure.

FIG. 1 is a perspective view of a compact antenna apparatus 100 for a mobile communication system according to an embodiment of the present disclosure. FIG. 2 is a diagram showing a state in which the compact antenna apparatus 100 is installed on a low-floor outer wall (or pillar) 10, in the compact antenna apparatus 100 for a mobile communication system according to the embodiment of the present disclosure.

The compact antenna apparatus 100 for a mobile communication system according to the embodiment of the present disclosure may include a radome 110, a phase shifter portion 130 (e.g., 130 in FIG. 3), and a rotary knob portion 120.

The radome 110 may include a plurality of radiating modules (e.g., 101, 102, 103 in FIG. 7) having at least one frequency band installed therein. Each of the plurality of radiating modules 101, 102, 103 has radiating elements for processing a transmitting and receiving signal in a specific frequency band. Generally, the plurality of radiating modules (and their radiating elements) may be installed, for example, vertically in series on a relatively large area of reflectors (e.g., 140 in FIG. 3) provided inside the radome 110.

The phase shifter portion 130 receives an input signal in the corresponding frequency band and distributes and outputs the input signal into and to a plurality of radiating modules in order to provide an electrical vertical tilt for the entire radiation beam radiated to the corresponding antenna apparatus. At this point, the signals distributed to each of the radiating modules vertically arranged in a row are varied complementarily so that the respective distributed signals have a proper phase difference from each other. The phase shifter portion 130 is typically implemented as a variable line structure in which a transmission line for transferring each of the distributed signals is mechanically or electrically variable in length, and has a structure in which the transmission line of the corresponding variable line structure is varied corresponding to external linear movement or rotation driving to vary the phase of the corresponding distributed signals. The phase shifter portion 130 provided in the antenna apparatus is typically driven by an electric driving portion including a motor and the like. However, according the embodiment of the present disclosure, the phase shifter portion 130 is configured to be driven according to a manual operation by an external operator without including the electric driving portion.

That is, according to the embodiment of the present disclosure, the rotary knob portion 120 (121, 122) that is exposed to the outside of the antenna apparatus 100 and is directly coupled to the phase shifter portion 130 to drive the phase shifter portion 130 is provided.

For example, the rotary knob portion 120 may be configured to be manually rotated by an external operator because a part exposed to the outside is provided in a shape similar to a dial knob. Further, the rotary knob portion 120 may internally have a mechanical connection structure in which it is connected to the phase shifter portion 130 so as to directly transmit a rotational driving force to the internal phase shifter portion 130 depending on a manual operation of an external operator.

The inside of the radome 110 may be added with various components (of relatively small size) for processing the transmitting and receiving signal, or the like besides a plurality of radiators and reflectors, the phase shifter portion, and a feeding circuit. The radome 110 surrounds the radiating module or the reflector and various components, and may be provided as an integral cylindrical shape.

The radome 110 may be configured in a cylindrical shape having a uniform cross-sectional area as a whole in order to minimize manufacturing process time and manufacturing process cost. Further, the radome 110 may be made of synthetic materials such as fiber reinforced plastic (FRP), acrylonitrile styrene acrylate (ASA), poly vinyl chloride (PVC), etc., and manufactured by melting the synthetic materials and extruding them using a preset extrusion mold. A lower portion of the radome 110 may be provided with a plurality of ports 111 (111*a*, 111*b*, 111*c*, and 111*d*) for inputting/outputting an internal radiating module transmitting/receiving signal and the like to/from the outside. The radome 110 may be supported and fixed to the outer wall 10 by the supporting part 11. The antenna apparatus 100 may be connected to a service band separator/combiner or the like, which may be separately installed outside through the plurality of ports 111.

According to the embodiment of the present disclosure, the antenna apparatus may have a multi-band antenna structure that serves a first frequency band and a second frequency band. The first frequency band may be a personal communication service (PCS) band of 1.8 GHz band and the second frequency band may be a broadband radio service (BRS) band of 2.5 GHz (for example, 2.495 to 2.690 GHz) band. Accordingly, the corresponding antenna apparatuses are separately provided with a phase shifter for processing signals for each band, respectively. Likewise, even the rotary knob portion 120 is separately provided for each band. FIGS. 1 and 2 exemplarily shows that the first rotary knob 121 for the first frequency band (PCS band) and the second rotary knob 122 for the second frequency band are provided. Further, the first and second ports 111*a* and 111*b* (P1 and P2) in the plurality of ports 111 may be provided to input and output a +45° polarized signal and a −45° polarized signal in the first frequency band, respectively and the third and fourth ports 111*c* and 111*d* (P3 and P4) in the plurality of ports 111 may be provided to input and output a +45° polarized signal and a −45° polarized signal in the second frequency band, respectively.

Meanwhile, the present disclosure describes by way of example that the corresponding antenna apparatus 100 has a multi-band antenna structure for serving two frequency bands. However, the present disclosure is not limited to thereto. Therefore, the present disclosure may have a structure of serving one radio frequency band and may have a structure of serving more than three radio frequency bands. However, it should be understood that the number of rotary knob portions 120 may be increased by having a multi-band antenna structure.

Figure 3:
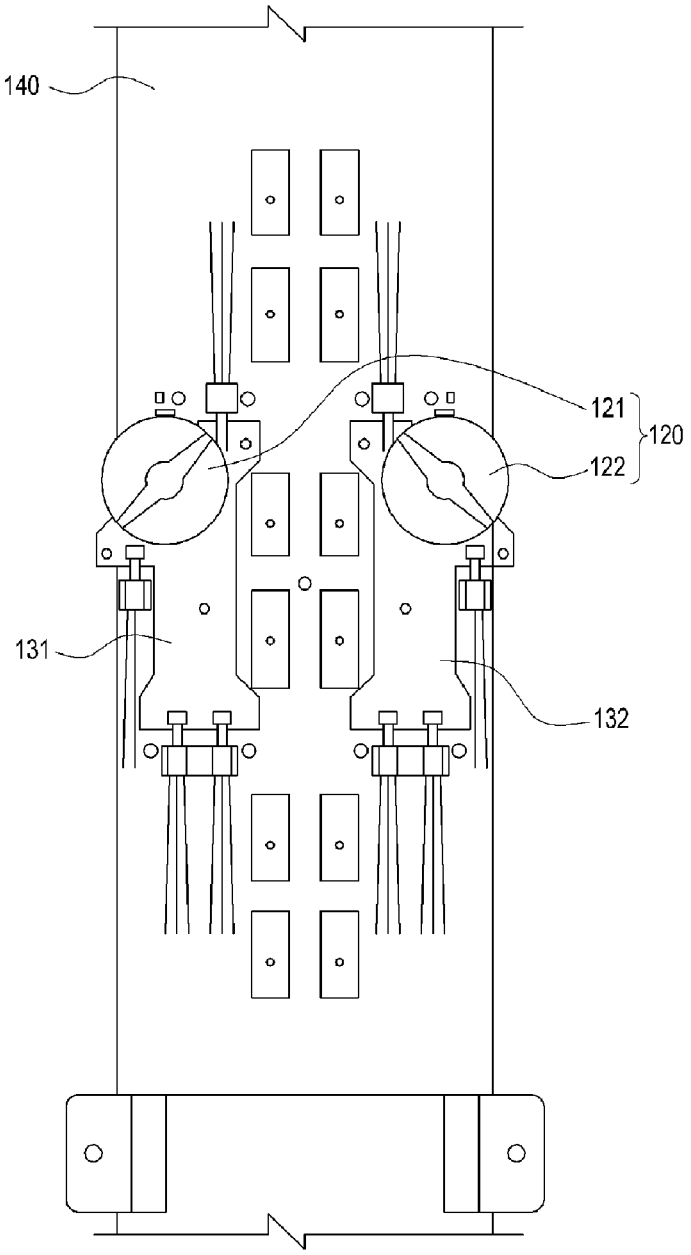
FIG. 3 is a plan view showing internal main parts of the compact antenna apparatus for a mobile communication system according to the embodiment of the present disclosure.
Figure 4:
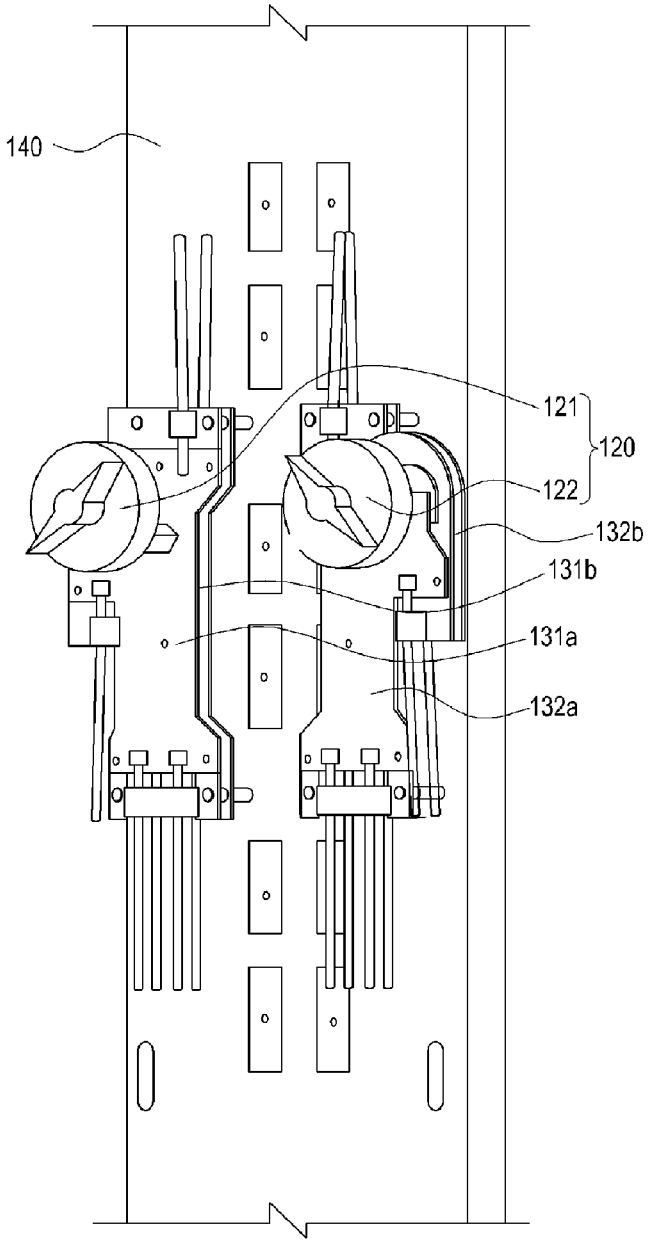
FIG. 4 is a perspective view showing the internal main parts of the compact antenna apparatus for a mobile communication system according to the embodiment of the present disclosure.

FIG. 3 is a plan view showing internal main parts of the compact antenna apparatus 100 for a mobile communication system according to the embodiment of the present disclosure and FIG. 4 is a perspective view showing the internal main parts of the compact antenna apparatus 100 for a mobile communication system according to the embodiment of the present disclosure and shows a rear structure of the inside of the corresponding antenna apparatus 100.

Referring to FIGS. 3 and 4, at least one phase shifter portion 130 is provided on, for example, a rear surface of the reflector 140 at an inner side of the radome 110 and is connected to the rotary knob portion 120 to adjust the tilting angle of the corresponding antennal apparatus depending on the manipulation of the rotary knob portion 120. At this time, although not directly shown in FIGS. 3 and 4, the front surface of the corresponding reflector 140 may be vertically provided properly with the plurality of radiating modules and the phase shifter portion 130 and the plurality of radiating modules may be electrically connected to each other through a transmission cable or the like that is installed through a through hole formed in the reflector 140.

As shown in FIGS. 3 and 4, the phase shifter portion 130 may include the first phase shifter portion 131 for the first frequency band and the second phase shifter portion 132 for the second frequency band. Further, the first phase shifter portion 131 may have a structure in which two phase shifter structures 131*a* and 131*b* for processing a +45° polarized signal and a −45° polarized signal in the first frequency band, respectively, are overlap with each other. Likewise, the second phase shifter portion 132 may have a structure in which two phase shifter structures 132*a* and 131*b* for processing a +45° polarized signal and a −45° polarized signal in the first frequency band, respectively, are overlap with each other.

Each of the first and second phase shifter portions 131 and 132 (and phase shifter structure thereof) includes a base substrate having a predetermined permittivity and a transmission line having a plurality of distribution structures formed on the corresponding base substrate.

Figure 5:
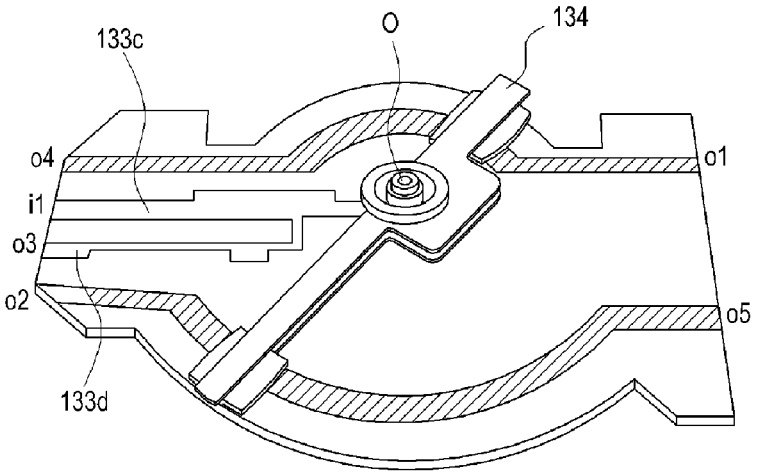
FIG. 5 is a view showing another example of a phase shifter portion of the compact antenna apparatus for a mobile communication system according to the embodiment of the present disclosure.

FIG. 5 is a view showing another example of the phase shifter portion 130 that may be applied to the compact antenna apparatus 100 for a mobile communication system according to the embodiment of the present disclosure. The structure of the phase shifter portion 130 that may be applied to the present disclosure will be described in more detail with reference to FIG. 5. The phase shifter portion 130 includes a base substrate 132 which may be a printed circuit board, or the like, a plurality of transmission lines formed on the base substrate 132, for example, an input line 133*c* connected to an input terminal i1 of a transmitting signal, and a plurality of output lines 133*a*, 133*b*, and 133*d* connected to output terminals o1, o2, o3, o4, and o5 for being distributed with the transmitting signals input from the input line 133*c* and outputting the transmitting signals to the respective radiating modules. In the example of FIG. 5, a first line 133*a*, a second line 133*b*, and a third line 133*c* as a plurality of output lines may be formed. In addition, a rotation line 134 for distributing and outputting the signal input from the input line 133*c* into and to the first line 133*a* and the second line 133*b* with a proper phase difference is provided.

The rotation line 134 is rotatably provided about a rotation axis O and is electrically connected to the input line 133*c* at the rotation axis O. One of both ends of the rotation line 134 is electrically connected to the first line 133*a* and the other end thereof is electrically connected to the second line 133*b*. When the rotation line 134 is rotated, the respective line patterns are properly designed so that the electrical connection between the rotation line 134 and the first line 133*a* and the second line 133*b* is maintained. Further, in this case, the third line 133*d* may be configured to output a signal input to the input line 133*c* to, for example, a third output terminal i3 as it is without changing a phase of the signal input to the input line 133*c*.

According to the above configuration, the signal input to the input line 133*c* is distributed into the first line 133*a* and output thereto, the second line 133*b*, and the third line 133*d*, and the signal distributed into the first line 133*a* is again distributed into both ends (o2 and o4 sides) of the corresponding first line 133*a* and the signal distributed into the second line 133*b* is again distributed into both ends (o1 and o4 sides) of the corresponding second line 133*b*. At this time, a length difference in the transmission paths of the signals distributed into the respective both ends of the first line 133*a* and the second line 133*b* arises complementarily according to the rotation position of the rotation line 134, and therefore a phase difference arises.

In this configuration, according to the embodiment of the present disclosure, the rotation operation of the rotation line 134 is configured to be interlocked with the rotary knob portion 120 depending on the manipulation, such that the phases of the signals output from the respective output lines (and/or both ends thereof) according to the operation of the rotary knob portion 120 may be properly adjusted.

Meanwhile, describing the structure of the phase shifter portion shown in FIG. 5, it can be appreciated that the signal input to one input terminal i1 is distributed into the first to fifth output terminals o1 to o5 with a phase difference from each other and is output thereto. It may be seen that the phase shifter portion has a structure that may be applied when a plurality of radiating modules, for example, five radiating modules are provided to correspond to the respective output terminals. If three radiating modules are provided, it is to be understood that the corresponding phase shifter portion may have a structure including only the first line 133*a* and the third line 133*d*.

Figure 6:
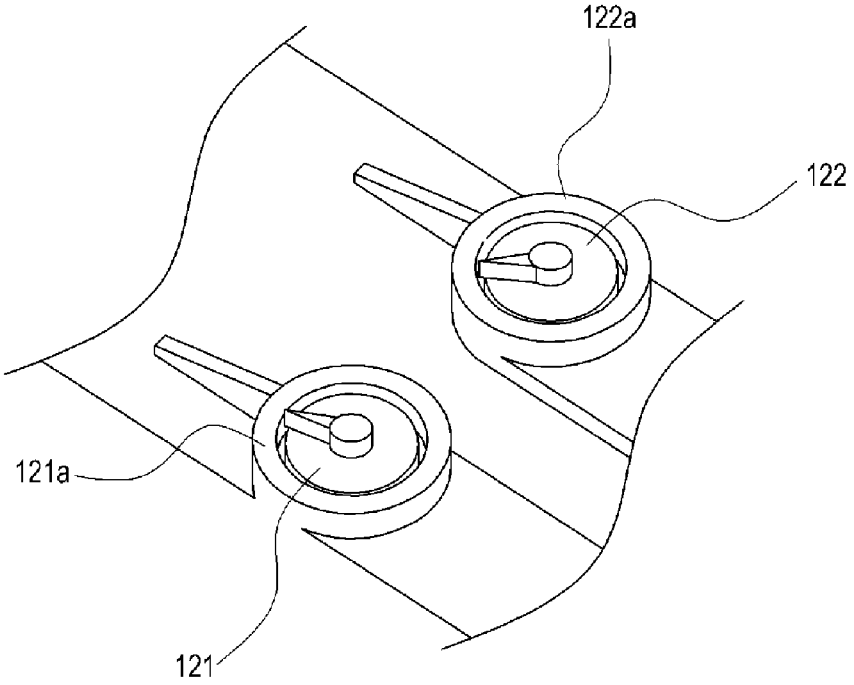
FIG. 6 is a view showing a rotary knob portion of the compact antenna apparatus for a mobile communication system according to the embodiment of the present disclosure.

FIG. 6 is a view showing the rotary knob portion 120 of the compact antenna apparatus 100 for a mobile communication system according to the embodiment of the present disclosure.

Referring to FIG. 6, the rotary knob portion 120 is provided to be exposed to the outside of the radome 110 and is directly coupled to the phase shifter portion 130 to drive the phase shifter. The rotary knob portion 120 may be provided on at least one of a rear surface, a side surface, and a bottom surface of the radome 110. According to the embodiment of the present disclosure, the case where the rotary knob portion 120 provided on the rear surface of the radome 110 will be described by way of example.

The embodiment of the present disclosure will describe by way of example that the radome 110 includes the first rotary knob portion 121 and the second rotary knob portion 122 so that the tilting angle may be varied by varying RF phases of the respective service frequency bands as the radome 110 is provided with the radiating module serving two specific frequency bands.

Further, as illustrated in FIG. 6, in order to facilitate the phase varying operation, the outsides of the installation positions of the first rotary knob portion 121 and the second rotary knob portion 122 may be additionally provided with dial scales 121*a* and 121*b* that display a phase variable amount in an appropriate unit.

Figure 7:
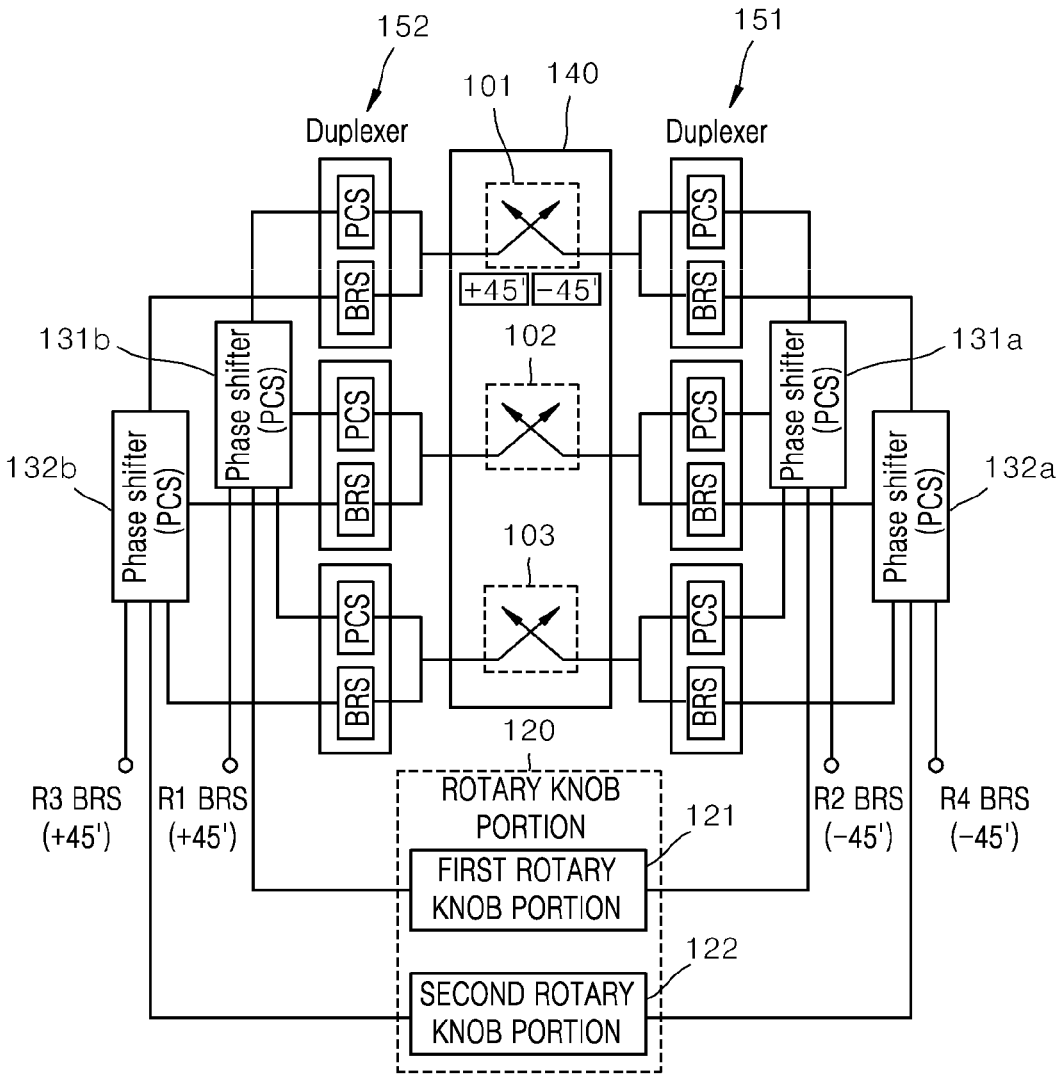
FIG. 7 is a block diagram showing a schematic internal circuit configuration of the compact antenna apparatus for a mobile communication system according to the embodiment of the present disclosure.

FIG. 7 is a block diagram showing an internal circuit configuration of the compact antenna apparatus 100 for a mobile communication system according to the embodiment of the present disclosure and shows a dual band antenna structure, for example. Referring to FIG. 7, in a dual band antenna apparatus according to an embodiment of the present disclosure, for example, first to third radiating modules 101, 102, and 103 of first and second frequency common bands may be provided on, for example, one reflector 140 that is upright in a longitudinal direction.

In recent years, the broadband radiating element having broadband characteristics have been provided to cover, for example, a band whose fractional band width is about 45%. The radiating element may, for example, have operating characteristics of the 1710 to 2690 MHz band. According to the embodiment of the present disclosure, the multi-band antenna is implemented using the broadband radiating element. In this case, as shown in FIG. 7, the radiating module that may be commonly used for the first and second frequency bands may be provided. Of course, the structure is for miniaturization of the corresponding antenna apparatus, and it will be understood that in some cases, separate radiating modules may be provided for each of the first frequency band and the second frequency band.

In the structure, in order to provide the electrical vertical tilt for the entire radiation beam of the first frequency band, the input signal of the first frequency band is received and distributed into the first to third radiating modules 101 to 103 and output thereto, and the first phase shifter 131 (131*a* and 131*b*) is provided to vary the respective distribution signals so that the signals distributed to the respective radiating modules have a preset phase difference from each other. Similarly, in order to provide the electrical vertical tilt with respect to the entire radiation beam of the second frequency band, the input signal of the second frequency band is received and distributed into the first to third radiating modules 101 to 103 and output thereto, and the second phase shifter 132 (132*a* and 132*b*) is provided to vary the respective distribution signals so that the signals distributed to the respective radiating modules have a preset phase difference from each other.

The corresponding signals of the plurality of signals distributed in the first phase shifter 131 and the plurality of signals distributed in the second phase shifter 132 are coupled to each other by a plurality of frequency combiners 151 and 152 and are provided to the corresponding radiating modules. The plurality of frequency combiners 151 and 152 may have a diplexer structure or a duplexer structure in which the structure of the filter unit for filtering the first frequency band and the structure of the filter unit for filtering the second frequency band are combined. Further, in the above description, the term "frequency combiner" is used, but it will be understood that the frequency combiner may have the configuration that serves as a frequency divider when it is considered that the directions of the input and output signals are reversed.

As shown in FIG. 7, the antenna apparatus according to the embodiment of the present disclosure has a structure of commonly process the radio signals of the first and second frequency bands using the plurality of frequency combiners 151 and 152 and the broadband radiating modules 101, 102, and 103, thereby reducing the entire antenna size.

Further, in the structure, the rotary knob portion 120 according to the embodiment of the present disclosure is provided, and if an operator changes the phase of the RF signal of the compact antenna apparatus 100 for a mobile communication system, the operator rotates the rotary knob portion 120 exposed to the outside of the radome 110. The length of the transmission line 133 is varied in the phase shifter portion 130 depending on the rotation of the rotary knob portion 120, and each of the radiating modules is varied by the tilting angle set by the operator and thus the phase of the RF signal may be varied.

As described above, the configuration and operation of the antenna apparatus 100 for a mobile communication system according to the embodiment of the present disclosure may be carried out. Meanwhile, while the present disclosure has been shown and described with reference to the detailed embodiments, various modifications may be performed without departing from the scope of the disclosure.

In the above description, it is described above that an extrusion vacuum molding method is applied to manufacture the radome 110 according to the embodiment of the present disclosure, but a blow molding method may be applied. In addition, the radome 110 may be molded using a variable extrusion molding method.

Further, it is described above that the service band separator/combiner is installed on the bottom surface of the radome 110 according to the embodiments of the present disclosure. In addition, the service band separator/combiner may be provided between the radome 110 and the outer wall 10 according to the installation between the antenna apparatus 100 and the outer wall 10 and may be provided to be drawn into the radome 110.

While the present disclosure has been described in connection with the exemplary embodiments thereof, it is obvious to those skilled in the art that various modifications and variations can be made without departing from the scope of the present disclosure.

The invention claimed is:

1. A compact antenna apparatus for a mobile communication system, comprising:

a radome having a plurality of radiating modules for at least one frequency band provided therein;

at least one phase shifter portion provided in the radome and connected to the plurality of radiating modules to change phases of signals provided to the plurality of radiating modules; and a rotary knob portion provided so as to be exposed to an outside of the radome and directly coupled to the phase shifter portion to drive the phase shifter portion depending on a manual manipulation, wherein the plurality of radiating modules includes radiating elements for a common frequency band of a first frequency band and a second frequency band, and the phase shifter portion includes a first phase shifter which receives an input signal of a first frequency band to distribute and provide signals having a phase difference from each other to the plurality of radiating modules and a second phase shifter which receives an input signal of a second frequency band to distribute and provide signals having a phase difference from each other to the plurality of radiating modules, and the compact antenna apparatus further includes a plurality of frequency combiners which couple corresponding signals from output signals of the first phase shifter and the second phase shifter, and provide the corresponding signals to a corresponding radiating module among the plurality of radiating modules.

2. The compact antenna apparatus of claim 1, wherein the compact antenna apparatus serves at least the first frequency band and the second frequency band, and the rotary knob includes a first rotary knob for the first frequency band and a second rotary knob for the second frequency band.

3. The compact antenna apparatus of claim 1, wherein the rotary knob is provided on at least one of a rear surface, a side surface, and a bottom surface of the radome.

4. The compact antenna apparatus of claim 1, wherein in the radome, an installation position of the rotary knob is additionally provided with a dial scale that displays a phase variable amount.

5. An antenna, comprising:

a radome;

a first radiating module and a second radiating module for at least one frequency band provided in the radome;

a first phase shifter and a second phase shifter provided in the radome, wherein the first phase shifter and the second phase shifter are interconnected to the plurality of radiating modules;

a first rotary knob and a second rotary knob each provided on an outer surface of the radome, the first rotary knob and the second rotary knob being manually rotatable, wherein the first rotary knob is coupled to the first phase shifter to adjust a phase difference of a first pair of signals output from the first shifter based on a first manual manipulation, and the second rotary knob is coupled to the second phase shifter to adjust a phase difference of a second pair of signals output from the second shifter based on a second manual manipulation;

at least one combiner which receives the first pair of signals from the first phase shifter and the second pair of signals from the second phase shifter, and provide an output signal to at least one of the plurality of radiating modules based on the first pair of signals and the second pair of signals.

6. The antenna of claim 5, wherein the first pair of signals have a first frequency band and the second pair of signals have a second frequency band, and the first rotary knob is configured to adjust the phase difference o for the first frequency band and the second rotary knob is configured to adjust the phase difference for the second frequency band.

7. The antenna of claim 5, wherein the rotary knob is provided on at least one of a rear surface, a side surface, and a bottom surface of the radome.

8. The antenna of claim 5, wherein in the radome, an installation position of at least one of the first rotary knob and the second rotary knob is additionally provided with a dial scale that displays a phase variable amount.

9. A method of adjusting phase differences of an antenna: wherein the antenna comprises:

a first radiating module and a second radiating module for at least one frequency band provided in a radome; and a first phase shifter and a second phase shifter provided in the radome, wherein the first phase shifter and the second phase shifter are interconnected to the plurality of radiating modules, and the method comprises:

manually rotating at least one of a first rotary knob and a second rotary knob, each provided on an outer surface of the radome, wherein the first rotary knob is coupled to the first phase shifter, to adjust a phase difference of a first pair of signals output from the first shifter based on a first manual manipulation, and a phase difference of a second pair of signals output from the second shifter based on a second manual manipulation;

combining the first pair of signals from the first phase shifter and the second pair of signals from the second phase shifter to provide an output signal to at least one of the plurality of radiating modules based on the first pair of signals and the second pair of signals.

10. The method of claim 9, wherein the first pair of signals have a first frequency band and the second pair of signals have a second frequency band, and the method further comprises:

manually rotating the first rotary knob to adjust the phase difference for the first frequency band and manually rotating the second rotary knob to adjust the phase difference for the second frequency band.

11. The method of claim 9, wherein the rotary knob is provided on at least one of a rear surface, a side surface, and a bottom surface of the radome.

12. The method of claim 9, wherein in the radome, an installation position of at least one of the first rotary knob and the second rotary knob is additionally provided with a dial scale that displays a phase variable amount.

* * * * *